US005473880A

United States Patent [19]

Leupers et al.

[11] Patent Number: 5,473,880

[45] Date of Patent: Dec. 12, 1995

[54] MULTI-STATION TEXTILE MACHINE, ESPECIALLY DOUBLE TWISTING MACHINE OR CABLING MACHINE, WITH SEQUENTIALLY ARRANGED SPOOL CONTAINERS

[75] Inventors: Wolfgang Leupers, Mönchengladbach; Siegfried Inger; Heinz Kamp, both of Kempen; Peter Schages, Krefeld, all of Germany

[73] Assignee: Palitex Project-Company GmbH, Krefeld, Germany

[21] Appl. No.: 116,458

[22] Filed: Sep. 3, 1993

[30] Foreign Application Priority Data

Sep. 5, 1992 [EP] European Pat. Off. ..... 92115216

[51] Int. Cl.[6] ..... D01H 9/18

[52] U.S. Cl. ..... 57/281; 198/704; 198/803.14; 414/911

[58] Field of Search ..... 57/281, 90; 242/35.5 A; 414/910, 911; 198/793, 803.14, 704, 487.1, 803.12

[56] References Cited

U.S. PATENT DOCUMENTS

| | | | |
|---|---|---|---|
| 1,130,568 | 3/1915 | Callow | 198/704 X |
| 3,429,113 | 2/1969 | Nimtz et al. | 57/281 |
| 3,599,413 | 8/1971 | Nimtz et al. | 57/281 X |
| 3,646,656 | 3/1972 | Zilahy et al. | 198/803.01 X |
| 4,171,739 | 10/1979 | Yamato | 198/704 |
| 4,928,476 | 5/1990 | Otoshima et al. | 57/281 X |
| 5,211,000 | 5/1993 | Fink et al. | 242/35.5 A X |
| 5,245,816 | 9/1993 | Mima | 57/281 |
| 5,301,497 | 4/1994 | Leupers | 57/281 |
| 5,316,126 | 5/1994 | Hirai | 198/487.1 X |

FOREIGN PATENT DOCUMENTS

| | | |
|---|---|---|
| 0379600 | 1/1989 | European Pat. Off. . |
| 1560263 | 7/1966 | Germany . |
| 3802900 | 2/1988 | Germany . |

*Primary Examiner*—Joseph J. Hail, III
*Attorney, Agent, or Firm*—Robert W. Becker & Associates

[57] ABSTRACT

A multi-station textile machine, especially a double twisting machine or cabling machine, has spool containers arranged adjacent to one another in rows for receiving feed spools. A guide rail of a continuously or intermittently driven endless conveyor extends about the periphery of the machine frame in close contact therewith and has spool holders for conveying the feed spools. The lowermost position of the feed spools conveyed by the spool holders defines a horizontal plane which is substantially at the same level as the plane defined by the upper side of the spool containers. The spool holders are spaced apart from one another by a distance which is three to eight times the distance between neighboring spool containers.

7 Claims, 6 Drawing Sheets

MULTI-STATION TEXTILE MACHINE, ESPECIALLY DOUBLE TWISTING MACHINE OR CABLING MACHINE, WITH SEQUENTIALLY ARRANGED SPOOL CONTAINERS

BACKGROUND OF THE INVENTION

The present invention relates to a multi-station textile machine, especially double twisting machine or cabling machine, with sequentially arranged spool containers for receiving feed spools and with a guide rail of a continuously or intermittently driven endless conveying device, having connected thereto spool holders for the feed spools, with the guide rail positioned in close contact with the machine frame and guided about the periphery of the machine frame.

In a machine of the aforementioned kind disclosed in German Patent 1 560 263, the endless conveying device in the form of a chain is arranged below the area of the machine spindles or the spool containers, wherein the chain has outwardly slanted spool receiving arms for facilitating the removal of feed spools and the positioning of winding spools and spool sleeves. The endless conveying device is located at an inwardly projecting recess of the machine frame so that the width of the machine is substantially not increased. The individual receiving arms, in place of which cups may be used, onto which the spools or sleeves are placed, are arranged at a spindle dividing distance relative to one another so that an operator has relatively little space for a close approach to the individual workstation, respectively, machine spindle.

In German patent 3 802 900 a further spool transport system coordinated with a multi-station textile machine is disclosed which contains an endless conveying belt also arranged at the lower machine portion onto which the individual spools or spool groups are placed. The conveying belt has a width corresponding to at least the width of the spool diameter so that a close approach by the operator to the machine is impossible. For the insertion of a fully wound feed spool the operator must always maintain a distance from the machine spindle which corresponds to the width of the conveying belt.

In both known spool transport systems relatively great height distances must be overcome for the manual insertion of feed spools, i.e., the individual feed spool or feed spool group must first be lifted before it can be inserted into the machine spindle, respectively, the spool container.

It is therefore an object of the present invention to provide a multi-station textile machine with a spool transport system which facilitates, on the one hand, manipulation, i.e., especially the manual insertion of fully wound feed spools into the individual machine spindles or spool containers, and, on the other hand, reduces the required manipulating time to a minimum.

BRIEF DESCRIPTION OF THE DRAWINGS

This object, and other objects and advantages of the present invention, will appear more clearly from the following specification in conjunction with the accompanying drawings, in which.

SUMMARY OF THE INVENTION

Figure 1:
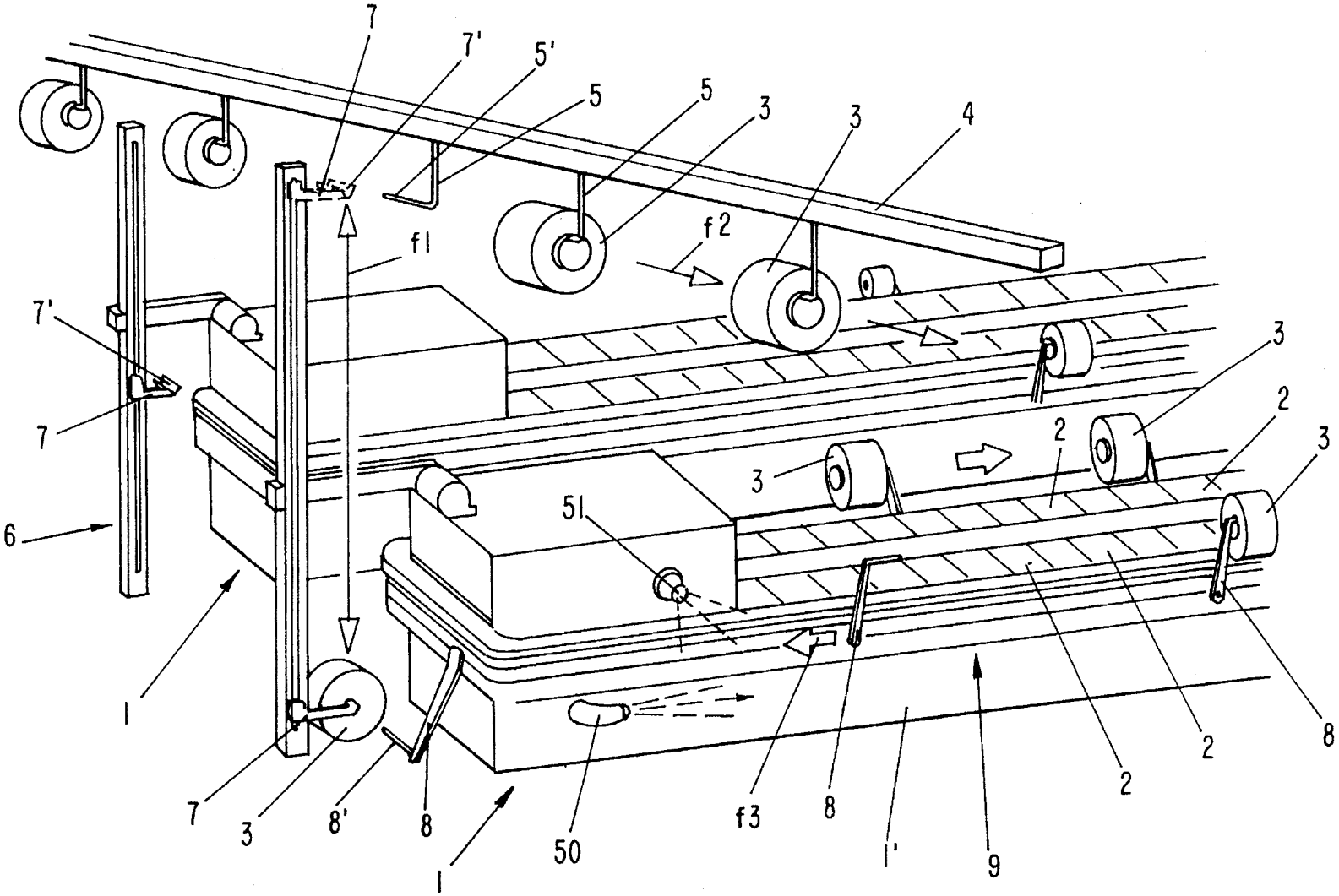
FIG. 1 shows a schematic, perspective view of a spool conveying system for supplying, for example, two multi-station textile machines, wherein each textile machine is provided with an inventive spool conveying device arranged closely about the periphery of the individual machine and having a first spool holder embodiment.

The multi-station textile machine according to the present invention is primarily characterized A machine frame having spool containers sequentially connected thereto for receiving feed spools;

An endless conveying device having spool holders for continuously or intermittently conveying the feed spools on the spool holders, the endless conveying system having a guide rail that extends about a periphery of the machine frame in close contact with the machine frame, wherein a horizontal plane defined by a lowermost point of the feed spools transported by the spool holders is substantially at a same level as a plane defined by an upper side of the spool container; and The spool holders conveyed by the conveying device spaced from one another 3 to 8 times a distance between neighboring ones of the spool containers.

Preferably, the conveying device comprises carriages with guide and support rollers, with each spool holder connected to one such carriage. The conveying device in this embodiment comprises guide and support rails connected to the periphery of the machine frame, with the guide and support rollers of the carriage supported on the guide and support rails. Preferably, each spool holder is pivotable about a vertical axis relative to the carriage.

Preferably, the spool holder is in the form of a basket. Expediantly, each spool holder in the form of a basket has an abutment at a rearward end thereof in a conveying direction of the conveying device. The abutment is preferably a plate that is pivotable about a horizontal axis that is perpendicular to the conveying direction. Advantageously, the multi-station textile machine further comprises a device for arresting the plate in an upwardly extending position, the device positioned in the area of the lifting device.

Expediently, the multi-station textile machine further comprises at least one monitoring device acting on each side of the periphery of the machine frame for interrupting operation of the conveying device when an operator or any other obstacle intercepts a travel path of the spool holders.

In a further embodiment of the present invention, the multi-station textile machine further comprises a lifting device connected to an end face of the machine frame, the lifting device comprising a spool carrier in the form of an L-shaped bracket that is connected to the lifting device so as to be moved in a substantially vertically reciprocating manner, the L-shaped bracket in the lowermost position being positioned in a travel path of the spool holders conveyed by the conveying device, with the free leg of the L-shaped bracket being horizontally arranged and pointing in a first direction counter to a conveying direction of the conveying device.

Preferably, the multi-station textile machine further comprises:

A transporting device for transporting the feed spools to the lifting device;

The transporting device comprising a transport rail and L-shaped suspending hooks slidably connected to the transport rail;

The transporting device positioned above the lifting device;

Wherein in an uppermost position of the L-shaped bracket of the lifting device a travel path of the L-shaped suspending hooks is intercepted by the L-shaped bracket; and Wherein a free leg of the L-shaped suspending hooks extends horizontally and points in said first direction.

Advantageously each spool holder has a receiving arm extending parallel to a conveying direction of the conveying device. Preferably, the receiving arm is pivotable about 180° from a first end position into a second end position and from said second end position into said first end position, wherein in the first end position a free end of the receiving arm points in the conveying direction for receiving a feed spool and in the second end position the free end of the receiving arm points counter to the conveying direction for removing the feed spool from the spool holder. Preferably, the multi-station textile machine further comprises a means for pivoting the receiving arm from the first end position into the second end position and vice versa.

Expediently, the means for pivoting is connected to the machine frame.

Preferably, the means for pivoting comprises a sensor for activating the means for pivoting only when one spool holder is without feed spool.

In an alternative embodiment of the present invention, the means for pivoting may be connected to the spool holder.

Expediently, the conveying system has first engaging means for engaging the spool holders and each spool holder has a second engaging means for engaging the first engaging means of the conveying device.

The difference between the present invention and the devices of the prior art is that the spool conveying device is arranged in such a manner that the feed spools advanced by the individual spool holders for the insertion into the textile machine must no longer be lifted. The individual feed spools must only be removed from the spool holder and in a horizontal movement inserted into the machine spindle, respectively, the spool container. A previous lifting of the feed spool is obsolete. In this context, it is of no consequence whether the individual feed spools are in an upright position or in lying position during transport.

A close approach to the machine during the feed spool insertion is made possible because the individual spool holders have a sufficient space between one another. For the individual manipulating operation the endless conveying device can advantageously be stopped, preferably controlled by a sensor, that, when an operator approaches the machine, is activated and turns off the endless conveying device.

The spool holders may have the shape of a basket or a tub or may be in the form of horizontally extending receiving arms that are oriented such that, for removing a feed spool from the spool holder, the operator must only place one hand in the travel path of the feed spool so that upon further movement of the endless conveying device the feed spool is stripped from the spool holder and is practically pushed into the hand of the operator. As soon as a feed spool has been removed from the spool holder, the operator, since a relatively great distance between adjacent spool holders is possible can move close to the textile machine in order to insert with the smallest possible amount of force the feed spool into the machine spindle.

According to a further embodiment of the present invention, the multi-station textile machine is provided with a lifting device for supplying feed spools to the individual spool holders that are moved about the periphery of the machine. The lifting device is designed such that the individual feed spools are removed automatically by the endless conveying device during its movement about the periphery of the machine.

According to a further embodiment of the present invention, for supplying feed spools to this lifting device a transporting device arranged above the lifting device is provided with which the feed spools are transferred to the lifting device also in an automated or "flying" manner.

DESCRIPTION OF PREFERRED EMBODIMENTS

The present invention will now be described in detail with the aid of several specific embodiments utilizing FIGS. 1 through 8.

FIG. 1 shows two multi-station textile machines 1, for example, double twisting machines or cabling machines, which are arranged parallel to one another and spaced apart.

Each textile machine 1 has at its longitudinal sides rows of adjacently arranged workstations 2 which are to be supplied with fully wound feed spools 3 after previous removal of empty spools from the individual workstations, i.e., machine spindles or spool containers. The common supply of feed spools 3 to the two textile machines 1 is carried out with a transporting device extending along the end faces of the multi-station textile machines 1. The transporting device is schematically represented by the transport rail 4 and the suspending hooks 5 positioned above the textile machines 1. In the area of the end face of the textile machines 1, a schematically represented lifting device 6 is arranged, each having a spool carrier in the form of an L-shaped bracket 7 that are vertically reciprocated in the direction of double arrows f1 by a non-represented drive means. The L-shaped suspending hooks 5 and the L-shaped brackets 7 have free legs 5' and 7' that extend parallel to the longitudinal extension of the transport rail 4 and point counter to the conveying direction shown by the arrow f2 of the transport device 4, 5.

Such an arrangement allows for a so-called "flying" spool transfer from a suspending hook 5 to the L-shaped bracket 7 when an L-shaped bracket 7 is in the uppermost position represented in a dash-dotted line in FIG. 1 in which it is substantially aligned with the free leg 5' of the suspending hook 5.

As soon as a feed spool 3 is transferred to the L-shaped bracket 7 it is then moved into the position, represented in solid lines in FIG. 1, in which the feed spool 3 is also transferred automatically, for example, to the receiving arm 8' of a pivotable spool holder 8 which represents a portion of the inventive spool conveying device.

Each textile machine 1 is provided with an endless rail system 9 for the spool holders 8 that extends horizontally about the periphery of the individual machine and is part of the inventive conveying device. The spool holders 8 are conveyed continuously or intermittently by a non-represented endless conveying means, for example, a chain conveyor, in the direction of the arrow f3.

The rail system 9 is inventively arranged at a height such that the feed spools 3, arranged on the upwardly pivoted spool holders 8, 8', their lowermost portion are positioned in a plane which is defined by the upper sides, respectively, upper edges of the spool containers that represent the workstations. Accordingly, the feed spools 3 removed from the receiving arms 8' can be inserted into the workstations 2 without having to overcome a substantial height difference.

In this manner it is also possible to simplify the supply to bobbin creels of cabling machines; such bobbin creels are commonly pivotable by a pivoting frame into a manipulation-friendly position.

The rail system 9 inventively extends closely about the periphery of the machine frame 1' in close contact therewith so that an operator, for insertion of a feed spool 3 into a workstation, can approach the workstation closely after a feed spool 3 has been removed from the receiving arm 8'.

Figure 2A:
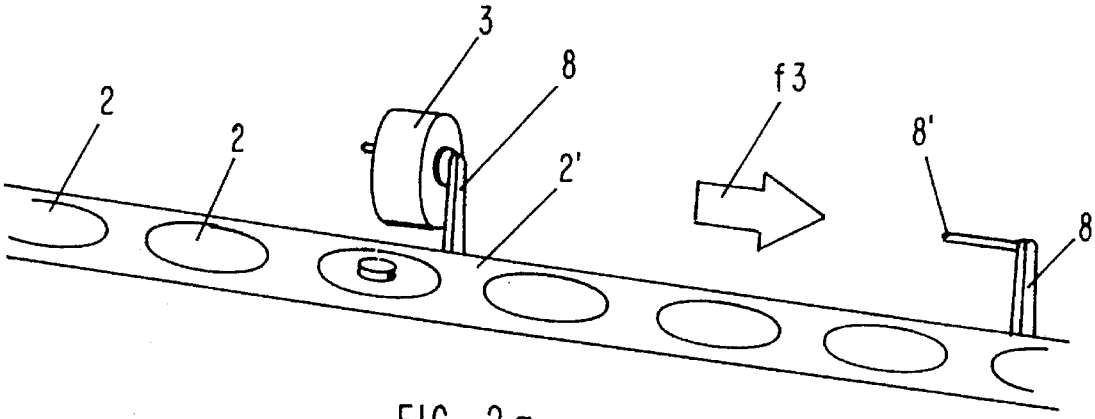
FIGS. 2*a*–2*c* show schematically sequential operating stages during the conveying and receiving of a feed spool at a workstation of the textile machine.
Figure 2B:
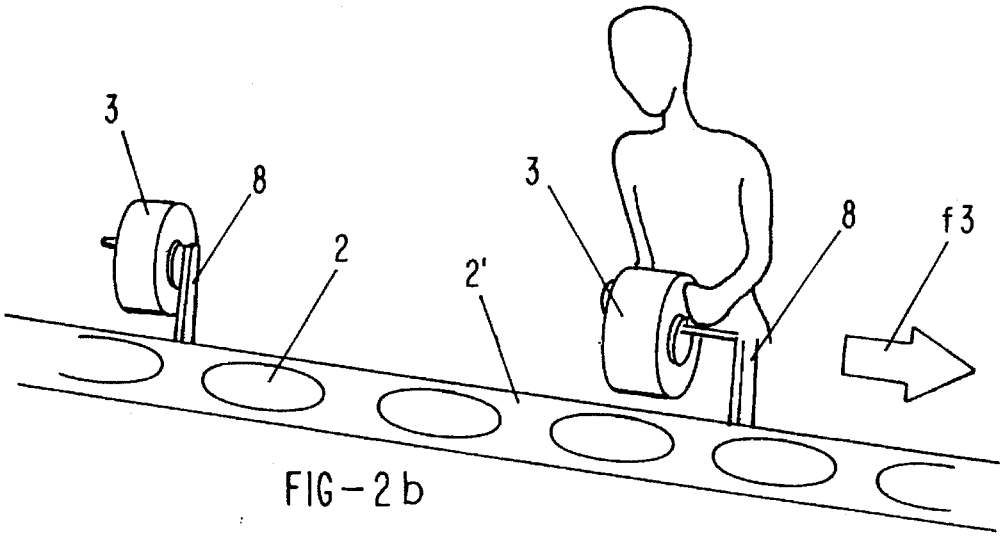
Figure 2C:
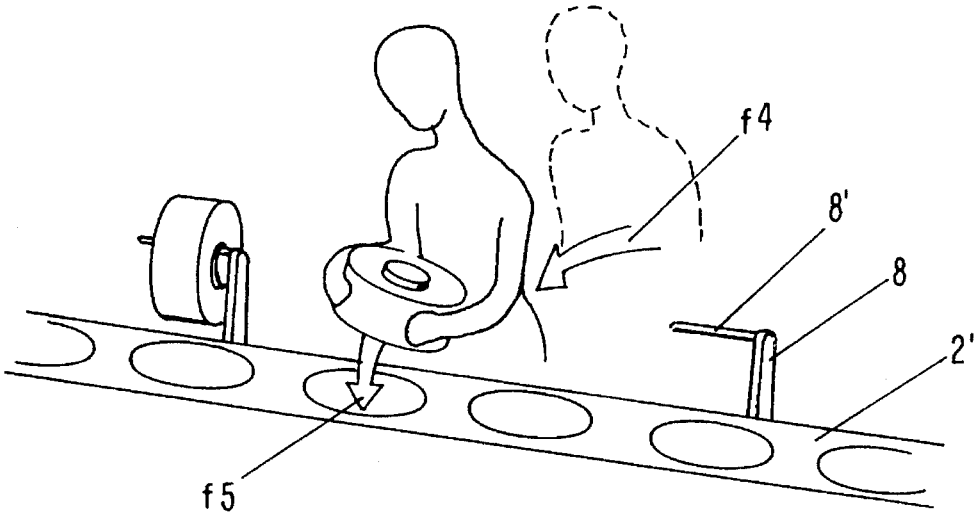

As represented in FIGS. 2*a*, 2*b*, and 2*c*, the inventive spool conveying device allows for the following manipulations:

1) As soon as an operator recognizes that within an area of a workstation, for example, a twisting spindle of a double twisting machine, a previously inserted feed spool is now empty, the operator approaches the machine frame, respectively, the spindle bank, to such an extent that the empty spool can be removed from the workstation. The operator thereby interrupts a light beam emitted in the longitudinal direction of the machine frame by a sensor 50 connected to the machine frame 1' so that the endless conveying device to which the spool holder 8 is connected is stopped. After completion of preparatory work and removal of the empty spool, the operator retreats from the machine to such an extent that the endless conveying device, controlled by the sensor 50, is started up and the feed spool 3 conveyed by the spool holder 8, 8' can pass the operator. This stage is substantially shown in the schematic representation of FIG. 2*a*.

2) According to FIG. 2*b*, for a conveying direction corresponding to arrow f3 the operator extends his left hand into the travel path of the feed spool 3 so that with the further transport of the feed spool 3 in the direction of arrow f3 the spool is automatically removed from the receiving arm 8'. Thus, a "flying" removal of the feed spool 3 is performed without requiring a great force to be exerted by the operator.

3) The operator then again approaches closely the machine frame 1' while simultaneously rotating the feed spool 3 in the direction of arrows f4 and f5 so that, controlled by the sensor 50, the endless conveying device is stopped again and the feed spool 3 can be inserted into the spool container 2, i.e., the workstation, of, for example, a double twisting spindle.

4) As soon as the operator retreats from the machine frame 1' the endless conveying device is again started by the sensor until a further manipulation, i.e., a new insertion of a feed spool into one of the other workstations 2, is required.

The distance between individual spool holders 8, 8' preferably corresponds to a multiple of the distance, preferably 3 to 8 times the distance, between neighboring workstations 2 such that the operator can work without uninterruption between subsequent spool holders.

For placing fully wound feed spools on the empty spool holders 8, 8', a suitable spool holder pivoting device, not represented, is arranged at the end face of the machine frame adjacent to the lifting device 6 in order to pivot an empty spool holder 8, 8' in the downward direction so that within the area of the lifting device 6 a new feed spool 3 can automatically be removed from the L-shaped bracket 7 and slipped onto the receiving arm 8'. After a feed spool 3 has been received by the spool holder 8, 8', the spool holder 8 must be pivoted in an upward direction with a suitable spool holder pivoting device. A sensor 51 controls the lifting device 6 and the spool holder pivoting device such that it is only operative when the sensor 51 detects an empty spool holder 8, 8'.

Figure 3:
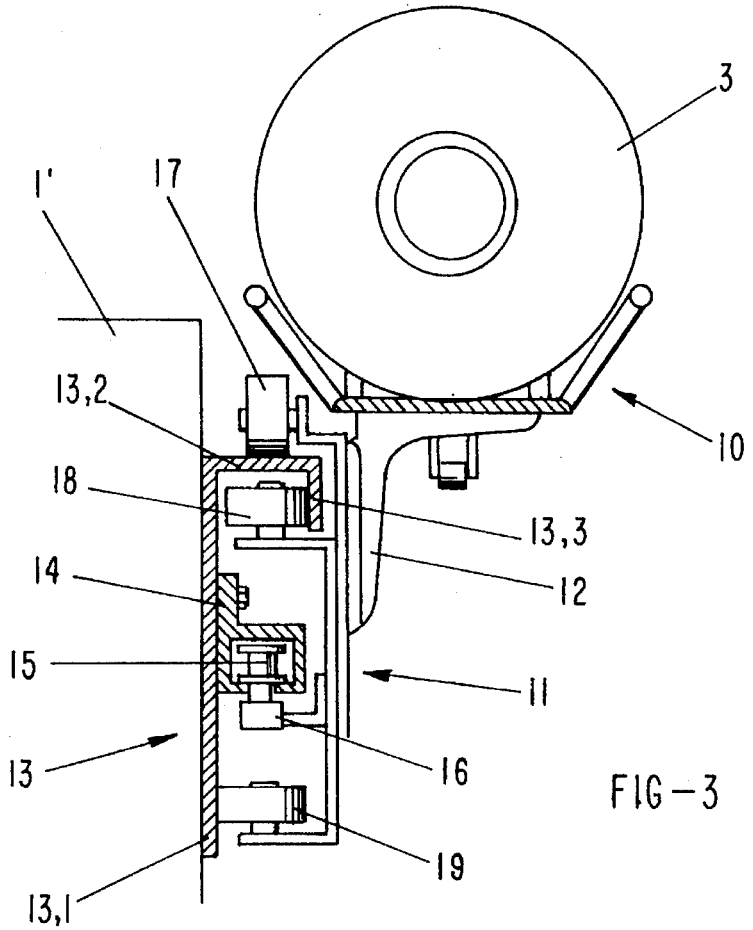
FIG. 3 shows a vertical cross-section of the spool conveying device with a second spool holder embodiment.
Figure 4:
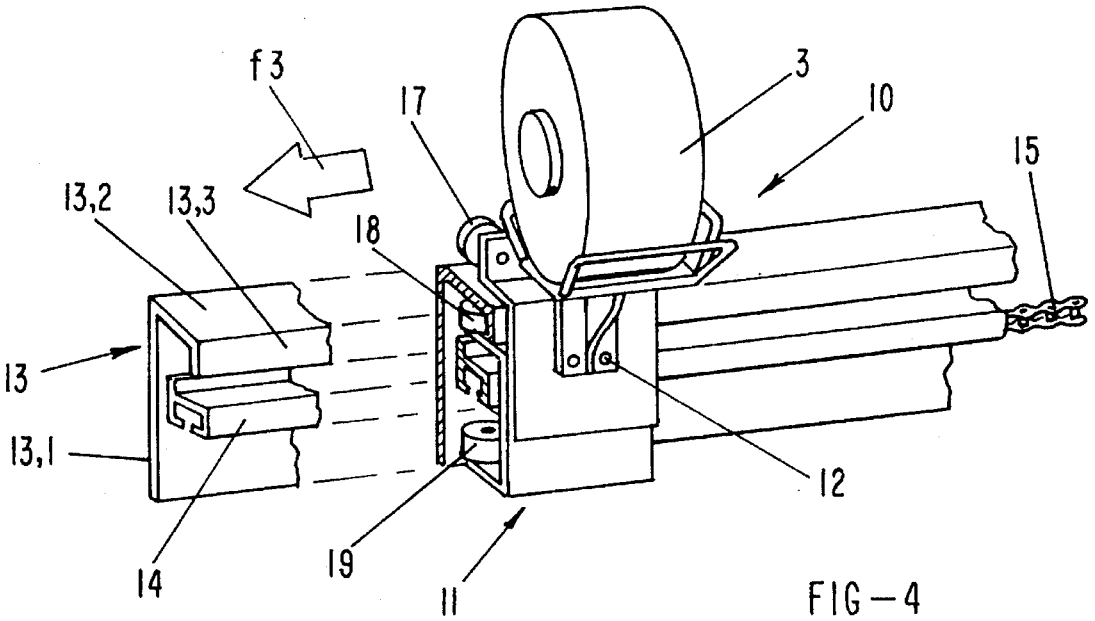
FIG. 4 shows in a perspective view a detail of the inventive spool conveying device according to FIG. 3.
Figure 5:
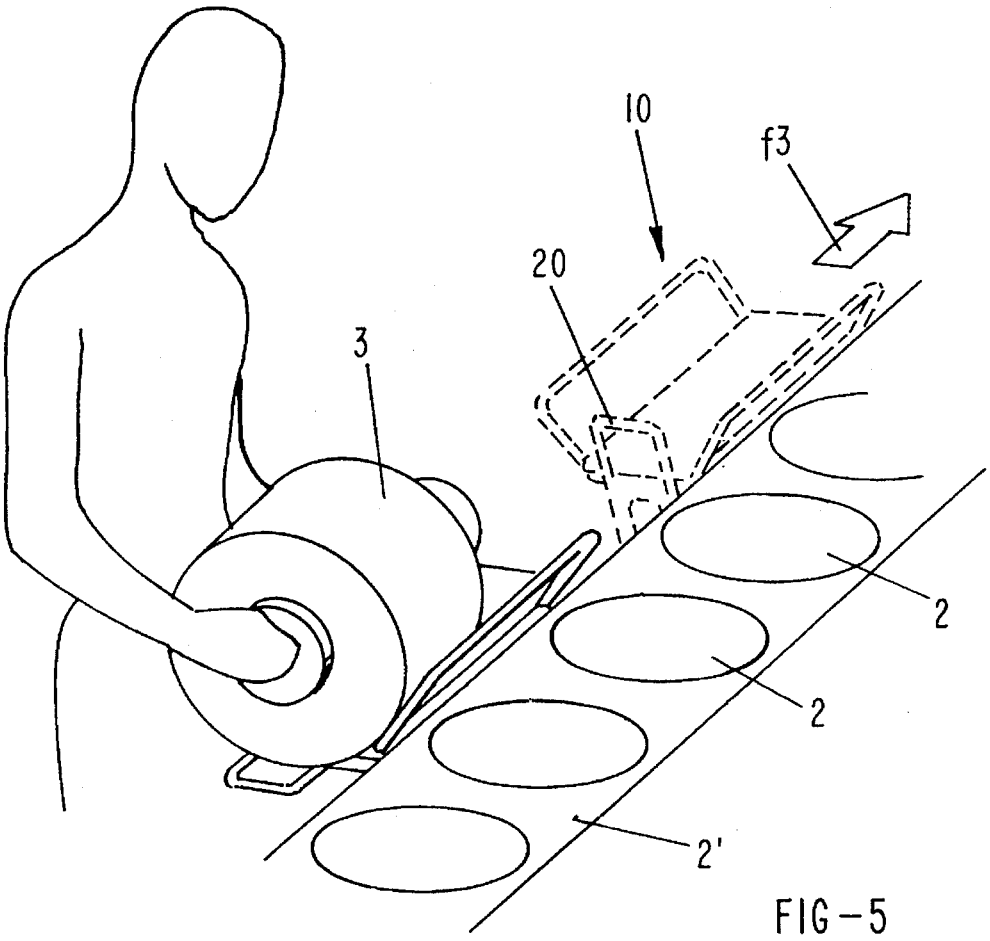
FIG. 5 shows a schematic representation of a detail of the inventive spool conveying device at the moment of a manual spool transfer.

FIG. 3 shows the inventive spool conveying device with a tub-or basket-shaped spool holder 10 for fully wound feed spools 3. FIG. 3 also shows the construction of the rail system 9 and a preferred embodiment of a carriage 11 that is movable along this rail system 9 and to which the spool holder 10 is connected with a support bracket 12. The stationary rail system 9 connected to the machine frame 1' is comprised of a main rail 13 having an L-shaped profile. The longer leg 13.1 is connected to the machine frame 1' while the shorter leg 13.2 extends outwardly from the upper longitudinal edge of the leg 13.1. At the end of the leg 13.1 remote from the leg 13.2 a flange strip 13.3 is provided which is bent in the direction of the longer leg 13.1. A guide rail 14 is connected to the leg 13.1 for guiding the aforementioned endless conveying means, preferably in the form of a chain conveyor 15, which with the aid of a non-represented drive element is driven in the direction of arrow f3 (FIG. 1) in a continuous or intermittent manner.

The carriages 11 are connected with suitable holders 16 at a suitable spacing to the chain conveyor 15. Each carriage 11 has at its upper side at least two rollers 17 which are rotatable about a horizontal axis and which are supported on the horizontal upper side of the shorter leg 13.2 of the main rail 13. Each carriage 11 has also support rollers 18 and 19 which are rotatable about vertical axes and are supported, on the one hand, on the inner side of the flange strip 13.3 or, on the other hand, at the lower end of the longer leg 13.1. The arrangement of the rollers 17, 18, and 19 is also conceivable in other varriants such that a secure support of the carriages 11, respectively, spool holders 10 along the main rail 13 is ensured.

The horizontal distance between the longer leg 13.1 and the flange strip 13.3 should be as small as possible.

Figure 7:
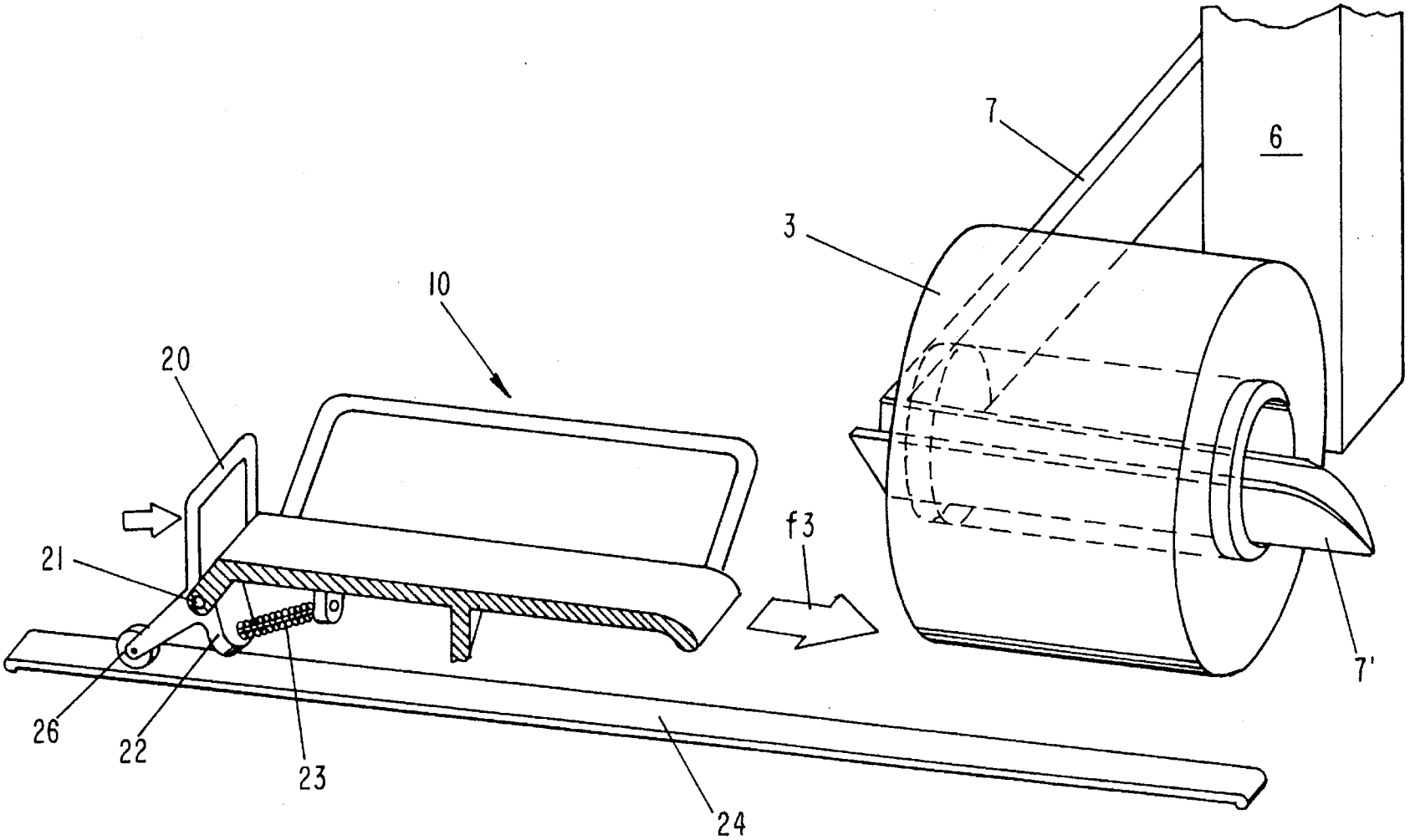
FIG. 7 shows schematically another operating position of a spool holder of the inventive spool conveying system.

At the rearward end of each spool holder 10, in the direction of movement of the chain conveyor 15, an abutment, preferably in the form of a plate 20, is provided Which is pivotable about a horizontal axis 21 that is perpendicular to the conveying direction of the chain conveyor 15. At a projection 22 of the plate 20 arranged below the axis 21 a spring 23 is arranged. The function of this arrangement is as follows:

At a spool transfer station 8, spool lifting means, which corresponds to the lifting device 6, positions a feed spool 3 in the travel path of the basket-shaped spool holder 10. In the area of such a spool transfer station a support rail 24 is provided which supports an arresting roller 26 connected to the lower arm 27 of a double-armed lever the upper arm of which is the plate 20. The plate 20 is thus forced into its upwardly extending position (FIG. 7). Upon movement of the chain conveyor 15 in the direction of arrow f3, the spool holder 10 is moved, with the plate 20 in its upwardly extending, arrested position, under the feed spool 3 suspended from the L-shaped bracket 7, 7' such that the feed spool 3 is removed by the plate 20 from the L-shaped bracket 7, 7'.

Figures 6A, 6B:
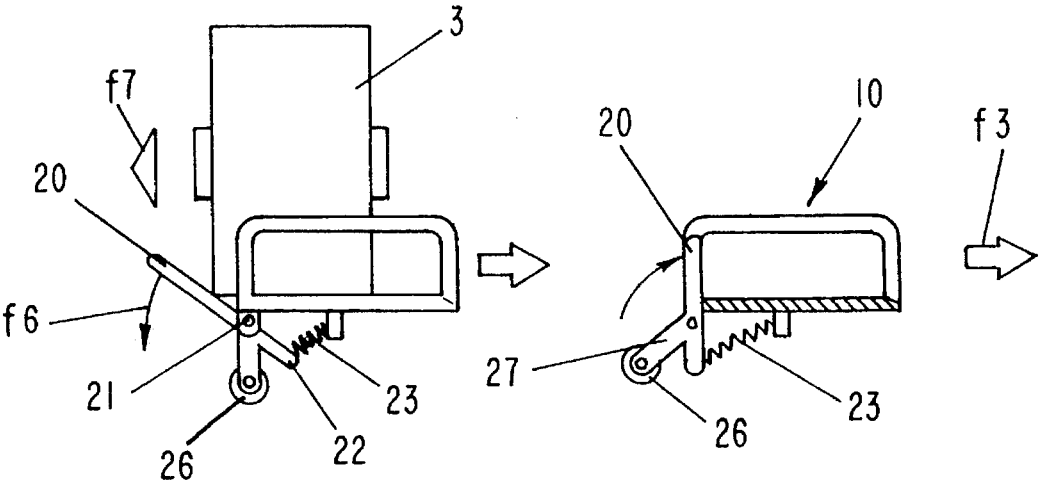
FIGS. 6*a*, 6*b* show schematically different operating positions of a spool holder of the inventive spool conveying device.

The spool removal from the spool holder 10 is performed essentially in the same manner as described above in connection with the spool holder 8, 8'. The plate 20 shown in the upper arrested position in FIGS. 6*b* and 7 is released after the arresting roller 26 leaves the support rail 24 and is pivoted in a downward direction by the tension spring 23 in the direction of arrow f6 so that a removal of a feed spool 3 in direction of arrow f7 is possible when, according to FIG. 5, an operator holds his left hand in the travel path of the feed spool 3.

The stopping and starting of the chain conveyor 15 for inserting a feed spool 3 into the workstation 2 is carried out substantially in the same manner as described above in connection with the FIGS. 2*a*, 2*b*, and 2*c*.

Figure 8:
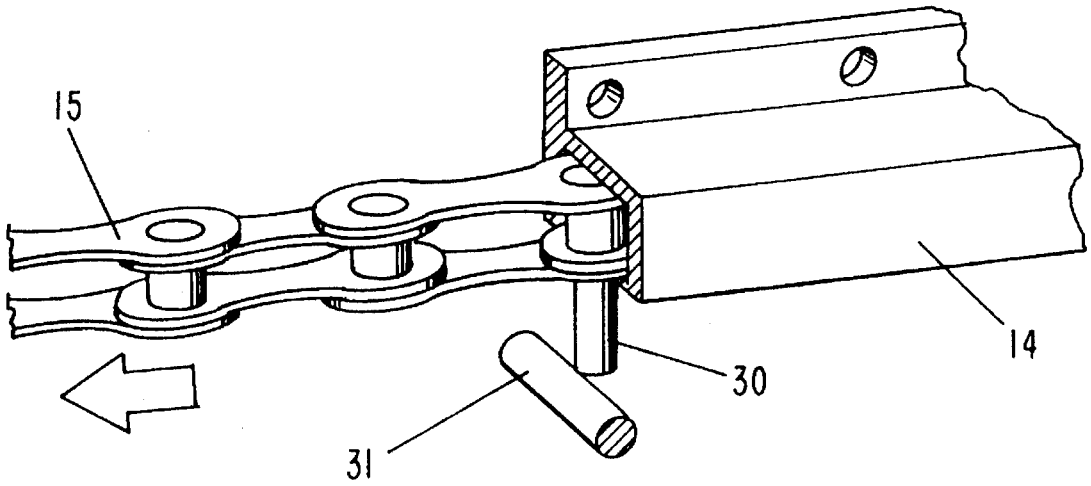
FIG. 8 shows an embodiment of engaging means of the spool holder and the chain conveyor.

According to FIG. 8, the chain conveyor 15 may be provided with simple downwardly extending engaging means, for example, engaging lugs 30 such that these engaging lugs 30 upon movement of the chain conveyor 15 engage behind corresponding engaging means 31 connected to the carriage 11. It is possible that, for example, after removal of a feed spool from the spool holder 8 or 10, the carriage 11 may be additionally pushed by hand away from the workstation so that the carriage 11 is advanced relative to the chain conveyor 15.

The tub- or basket-shaped spool holder 10 may be pivotable about a vertical axis, especially about an angle of 90°, relative to the carriage 11, for example, against the force of a return spring, so that the spool holder in front of a spool container can be moved into such a rotational position that the feed spool can simply be pushed back into the spool container.

The present invention is, of course, in no way restricted to the specific disclosure of the specification and drawings, but also encompasses any modifications within the scope of the appended claims.

What we claim is:

1. A multi-station textile machine comprised of:

a machine frame having spool containers sequentially connected thereto for receiving feed spools;

an endless conveying device having spool holders for continuously or intermittently conveying the feed spools on said spool holders, said endless conveying device having a guide rail that extends about a periphery of said machine frame in close contact with said machine frame, wherein a horizontal plane defined by a lowermost point of the feed spools transported by said spool holders is substantially at a same level as a plane defined by an upper side of said spool containers;

said spool holders conveyed by said conveying device spaced from one another 3 to 8 times a distance between neighboring ones of said spool containers; and each said spool holder having an abutment at a rearward end thereof in a conveying direction of said conveying device, said abutment pivotable about a horizontal axis that is perpendicular to said conveying direction.

2. A multi-station textile machine according to claim 1, wherein:

said conveying device comprises carriages with guide and support rollers, with each said spool holder connected to one said carriage; and said conveying device comprises guide and support rails connected to said periphery, with said guide and support rollers supported on said guide and support rails.

3. A multi-station textile machine according to claim 2, wherein said spool holder is in the form of a basket.

4. A multi-station textile machine according to claim 1, wherein said abutment is a plate.

5. A multi-station textile machine according to claim 4, further comprising a device for arresting said plate in an upwardly extending position, said device positioned in the area of a lifting device for the feed spools.

6. A multi-station textile machine according to claim 1, wherein said conveying device has a first engaging means for engaging said spool holders and each said spool holder has a second engaging means for engaging said first engaging means of said conveying device.

7. A multi-station textile machine comprised of:

a machine frame having spool containers sequentially connected thereto for receiving feed spools;

an endless conveying device having spool holders for continuously or intermittently conveying the feed spools on said spool holders, said endless conveying device having a guide rail that extends about a periphery of said machine frame in close contact with said machine frame, wherein a horizontal plane defined by a lowermost point of the feed spools transported by said spool holders is substantially at a same level as a plane defined by an upper side of said spool containers;

said spool holders conveyed by said conveying device spaced from one another 3 to 8 times a distance between neighboring ones of said spool containers;

each said spool holder having an abutment at a rearward end thereof in a conveying direction of said conveying device; and said abutment is a plate that is pivotable about a horizontal axis that is perpendicular to said conveying direction.

* * * * *